US007530132B2

(12) United States Patent
Kim

(10) Patent No.: US 7,530,132 B2
(45) Date of Patent: May 12, 2009

(54) METHOD FOR CONTROLLING SPINNING IN DRUM-TYPE WASHING MACHINE

(75) Inventor: Jae Mun Kim, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 658 days.

(21) Appl. No.: 11/067,206

(22) Filed: Feb. 28, 2005

(65) Prior Publication Data

US 2005/0283919 A1 Dec. 29, 2005

(30) Foreign Application Priority Data

Jun. 25, 2004 (KR) ..... 10-2004-0048090

(51) Int. Cl.
*D06F 33/00* (2006.01)

(52) U.S. Cl. ..... 8/158; 8/159

(58) Field of Classification Search ..... 8/158–159
See application file for complete search history.

(56) References Cited

U.S. PATENT DOCUMENTS 5,469,719 A * 11/1995 Imai et al. ..... 68/12.04
5,970,555 A 10/1999 Baek et al.
6,240,586 B1 * 6/2001 Joo ..... 8/159
6,553,596 B2 * 4/2003 Kim et al. ..... 8/159
2003/0213070 A1 * 11/2003 Lee et al. ..... 8/159

FOREIGN PATENT DOCUMENTS

DE 44 31 846 A1 3/1996
DE 198 22 717 A1 11/1998

* cited by examiner

*Primary Examiner*—Michael Barr
*Assistant Examiner*—Jason Heckert
(74) *Attorney, Agent, or Firm*—Birch, Stewart, Kolasch & Birch, LLP

(57) ABSTRACT

A method and apparatus control a drum-type washing machine during a dewatering process in which a motor, coupled to a drum, rotates the drum to extract water from laundry contained in the drum. The method includes rotating the motor at a first rotating speed; performing at least one eccentricity detection at the first rotating speed, to obtain an eccentricity value; accelerating, if the obtained eccentricity value is within a nominal range, the motor from the first rotating speed to a second rotating speed, the second rotating speed being lower than a resonance range of the motor and rotated drum; and entering a main dewatering phase based on the at least one eccentricity detection. The second rotating speed of the motor is maintained at a constant level for a predetermined time before the main dewatering phase is entered. The constant level may be applied to a preliminary dewatering stage performed prior to the first rotating speed acceleration.

25 Claims, 8 Drawing Sheets

METHOD FOR CONTROLLING SPINNING IN DRUM-TYPE WASHING MACHINE

This application claims the benefit of Korean Application No. 10-2004-0048090 filed on Jun. 25, 2004, which is hereby incorporated by reference.

BACKGROUND OF THE INVENTION

1. Field of the Invention

The present invention relates to a method and apparatus for controlling a drum-type washing machine, and more particularly, to a method in which, before entry into a main dewatering phase of a dewatering process performed by a controlled spinning of a drum driven by a motor, the motor speed is maintained for a predetermined time at a rotating speed below a resonance range.

2. Discussion of the Related Art

In a drum-type washing machine, laundry placed in a rotatable drum accommodating washing water is washed using a friction generated between the laundry and drum when the drum is rotated by a driving force, to obtain a washing effect by beating and rubbing the laundry. Drum-type washing machines are advantageous in that tangling and damage to the laundry are minimal. FIG. 1 illustrates a direct-coupling drum-type washing machine as an exemplary apparatus according to a related art.

Referring to FIG. 1, a drum shaft 13, coupled to a drum 9 that has a plurality of lifts 14 attached to an inner surface and is rotatably installed in a tub 3 housed within a cabinet 5, transmits a driving force to the drum from a motor 6 including a stator 7 and a rotor 8 provided at the rear of the drum. To facilitate drum rotation, a set of bearings 12 in contact with opposite ends of the drum shaft 13 is supported in a bearing housing centrally disposed on a rear wall of the tub 3. The stator 7 is fixed to the rear wall of the tub 3, and the rotor 8 is fixed to the drum shaft 13. Thus, the drum 9 is directly coupled to, and rotated by, the rotor 8.

A gasket 2 is provided between the tub 3, and a door 1 installed in the front of the cabinet 5. The tub 3 is suspended on springs 4 hanging from within the cabinet 5 and is supported by a damper 10 having opposite ends respectively connected the tub and cabinet. During a dewatering process, which is performed by a high-speed rotation of the drum 9 while the tub 3 is full of water for repeated steps of a wash course, vibration is generated in the gasket 2 and, more importantly, in the tub. Therefore, drum speed is controlled by detecting a rotating speed of the rotor 8 using a motor sensor 11, such as a Hall sensor or the like, attached to one side of the motor 6. Throughout dewatering, a drain pump 15 is activated to expel from the washing machine all the water contained in the tub 3 and to extract, by simultaneously spinning the drum 9, a maximum amount of the water absorbed into the laundry in the drum.

A controller 16, including a microprocessor with memory, is installed behind a control panel on a forward surface of the cabinet 5 to enable access and operation by a user. The dewatering process is performed according to an algorithm stored in the memory and executed by the microprocessor according to an amount of laundry in the drum 9 as detected at the beginning of a wash cycle, which is part of a wash course selected by the user via the controller 16.

A contemporary dewatering process will be described with reference to FIGS. 2 and 3.

Upon initiation of a dewatering cycle, the drain pump 15 is activated and water begins to drain from the tub 3, reducing the load accordingly. The motor 6 is accelerated (S307) to a first rotating speed for eccentricity detection (S308), and this eccentricity detection speed is maintained while a state of balance or imbalance (eccentricity) in the rotating drum is determined. Assuming that the detected eccentricity falls within a nominal range (S309), the motor 6 is accelerated further to a second rotating speed for extracting water from the laundry; otherwise, the drum rotation is paused (S320) so that the steps S307 and S308 can be repeated for a slightly reduced water load. It should be appreciated that each instance of eccentricity detection is countable during the execution of the wash course algorithm, so that the dewatering process may be performed according to an updated counter value (n) of, say, n=1, 2, or 3 (S310).

Upon reaching the second rotating speed (S311), the rotational speed of the motor 6 is immediately reduced (S313) to the first rotating speed for eccentricity detection to be again performed. Assuming that the detected eccentricity again falls within an expected (nominal) range, the counter is updated, and the rotational speed of the motor 6 is increased to a third rotating speed (S314), which is higher than then second rotating speed, after which the motor speed is again reduced to the first rotating speed (S315) for another eccentricity detection. Here, too, as soon as the higher rotating speed is reached, the rotational speed of the motor 6 is immediately reduced to the eccentricity detection speed, i.e., the first rotating speed.

After completing the above sequence of eccentricity detections, and assuming the rotating drum's state of balance falls within an acceptable range, the dewatering process enters the main dewatering phase (S316), whereupon the rotational speed of the motor 6 is increased to a maximum rotating speed set according to the amount of laundry detected at the beginning of the wash cycle. Throughout the dewatering process, the drain pump 15 continues to pump water from the tub 3, extracting more and more water, thereby reducing the load of the spinning drum and lowering its detected levels of eccentricity as determined by the microprocessor of the controller 16, which periodically senses load variations exerted on the motor 6. At the same time, i.e., as the amount of water in the tub 3 is being reduced, the cycling of the drum speed promotes a settling (even distribution) of the laundry in the drum 6. It should be appreciated that the main dewatering phase may be entered after any number of eccentricity detections provided that an acceptable level of eccentricity has been reached.

In the dewatering process as described above, however, the immediate reduction in drum motor speed upon reaching an accelerated speed, e.g., the second or third rotating speed, provides insufficient time for appreciable water extraction. This problem is exacerbated when the laundry includes materials capable of retaining greater amounts of water and can lead to dewatering times of five minutes or longer, since the amount of water in the laundry, and in turn the load of the motor 6, is nearly the same for the next acceleration, which unnecessarily prolongs the dewatering process by delaying entry to the main dewatering phase. Furthermore, the higher loads produces a sharp rise in eccentricity for the ensuing stage of drum motor acceleration, generating undue noise levels caused by the tub 3 striking an interior surface of the cabinet 5 and an excessive twisting of the gasket 2, and may even result in a "walking" phenomenon in the washing machine. These drawbacks are particularly troublesome as the drum motor is accelerated to the second or third rotating speed to pass through a rotating speed at which resonance occurs, without considering the sharp rise in eccentricity, which is due to the drum motor speed being reduced to the eccentricity detection speed too soon after an accelerated state.

SUMMARY OF THE INVENTION

Accordingly, the present invention is directed to a method and apparatus for controlling a drum-type washing machine that substantially obviates one or more problems due to limitations and disadvantages of the related art.

An object of the present invention is to provide a method for controlling a drum-type washing machine, which can reduce the time required to perform dewatering while maximizing system stability by considering sharp rises in eccentricity levels upon advancing to a next drum motor acceleration stage.

It is another object of the present invention is to provide a method for controlling a drum-type washing machine, which can reduce the eccentricity levels experienced at the onset of the next drum motor acceleration stage.

It is another object of the present invention is to provide a method for controlling a drum-type washing machine, which enables a dewatering process to advance to the next drum motor acceleration stage with a reduced eccentricity level.

It is another object of the present invention is to provide a method for controlling a drum-type washing machine, which can prevent the occurrence of a "walking" phenomenon.

It is another object of the present invention is to provide a method for controlling a drum-type washing machine, which can reduce noise levels generated by an excessive twisting of a gasket or by the tub striking the cabinet.

It is another object of the present invention is to provide a method for controlling a drum-type washing machine, which facilitates an early entry to a main dewatering phase.

It is another object of the present invention is to provide an apparatus suitable for realizing the above methods.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages in accordance with the purpose of the invention, as embodied and broadly described herein, there is provided a method for controlling a drum-type washing machine during a dewatering process in which a motor, coupled to a drum, rotates the drum to extract water from laundry contained in the drum. The method comprises rotating the motor at a first rotating speed; performing at least one eccentricity detection at the first rotating speed, to obtain an eccentricity value; accelerating, if the obtained eccentricity value is within a nominal range, the motor from the first rotating speed to a second rotating speed, the second rotating speed being lower than a resonance range of the motor and rotated drum; and entering a main dewatering phase based on the at least one eccentricity detection, wherein the second rotating speed of the motor is maintained at a constant level for a first predetermined time before the main dewatering phase is entered.

The method may further comprise performing, after the second rotating speed acceleration, a successive eccentricity detection at the first rotating speed, to obtain a successive eccentricity value; and accelerating, if the obtained successive eccentricity value is within a corresponding nominal range, the motor from the first rotating speed to a third rotating speed, to thereby accelerate the motor through the resonance range. The main dewatering phase is entered based two successive eccentricity values obtained by the at least one eccentricity detection.

According to another aspect of the present invention, the method further comprises at least one preliminary dewatering stage performed prior to the first rotating speed acceleration, by accelerating a motor from the eccentricity detection speed to a preliminary dewatering speed; maintaining the preliminary dewatering speed at a constant level for a second predetermined time; and then decelerating the motor. Preferably, the motor is first accelerated to an eccentricity detection speed to determine eccentricity of the rotated drum.

In another aspect of the present invention, there is provided a method for controlling a drum-type washing machine during a dewatering process in which a motor, coupled to a drum, rotates the drum to extract water from laundry contained in the drum. The method comprises rotating the motor at a preliminary dewatering speed and then decelerating the motor to a stopped state; accelerating the motor from the stopped state to a first rotating speed; performing at least one eccentricity detection at the first rotating speed, to obtain an eccentricity value; accelerating, if the obtained eccentricity value is within a nominal range, the motor from the first rotating speed to a second rotating speed, the second rotating speed being lower than a resonance range of the motor and rotated drum; and entering a main dewatering phase based on the at least one eccentricity detection, wherein the preliminary dewatering speed of the motor is maintained at a constant level for a predetermined time before the main dewatering phase is entered.

In another aspect of the present invention, there is provided an apparatus for performing a dewatering process in which a motor, coupled to a drum, rotates the drum to extract water from laundry contained in the drum. The apparatus comprises a controller, having a microprocessor and memory, for controlling the dewatering process according to a wash course algorithm stored in the memory and executed by the microprocessor, by controlling the motor based on an eccentricity value detected according to the drum rotation, wherein, during the dewatering process, the motor is rotated at a first rotating speed; the eccentricity value is obtained by performing at least one eccentricity detection at the first rotating speed; and the motor is accelerated from the first rotating speed to a second rotating speed if the obtained eccentricity value is within a nominal range, the second rotating speed being lower than a resonance range of the motor and rotated drum, wherein a main dewatering phase is entered based on the at least one eccentricity detection, and wherein the second rotating speed of the motor is maintained at a constant level for a predetermined time before the main dewatering phase is entered.

In another aspect of the present invention, there is provided a drum-type washing machine, comprising a drum; a motor, coupled to the drum, for rotating the drum to extract water from laundry contained in the drum by performing a dewatering process and for outputting an eccentricity value detected according to the drum rotation; and a controller as described above.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 4:
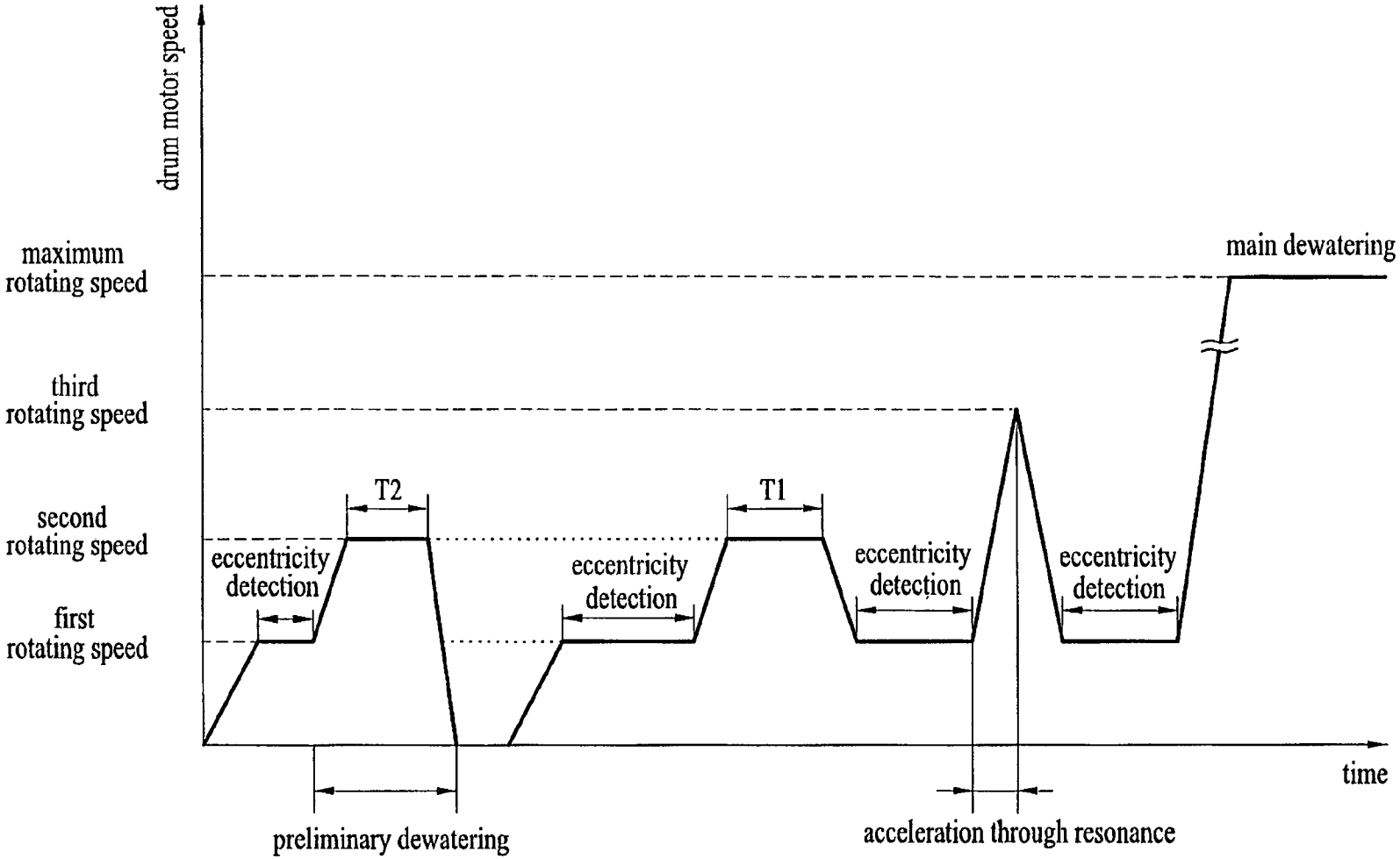
FIG. 4 is a graph for describing a dewatering process according to a preferred embodiment of the method of the present invention.

The described embodiments of the method of the present invention pertain to a control of a dewatering process performed by a drum-type washing machine according to an algorithm stored in memory and executed by a microprocessor included in the controller 16. Each embodiment will be described with reference to FIG. 4, illustrating a dewatering process according to a preferred embodiment of the present invention, which may include or exclude a preliminary dewatering stage; in any case, high-speed drum rotation occurs according to an eccentricity detection resulting in an entry to the main dewatering phase. Also, though not specifically shown in FIG. 4, the dewatering process may be precluded by or initiated with a laundry untangling step in which slow and/or intermittent drum rotation is carried out immediately following a wash or rinse cycle.

As shown in FIG. 4, a drum-type washing machine performs a main dewatering at a maximum rotating speed, i.e., the main dewatering speed, which is set according to a detected amount of laundry and is a drum motor speed controlled to perform the main dewatering under stable conditions. Importantly, the maximum rotating speed is reached, after eccentricity detection at a predetermined lower rotating speed, by accelerating through a resonance range determined by characteristics of a drum spinning in the washing machine. Therefore, the method of the present invention is characterized in that at least one acceleration of the drum motor to a predetermined rotating speed, which is higher than an eccentricity detection rotating speed but lower than resonance, is performed prior to a main dewatering phase. The accelerated state of the drum motor is maintained at a constant level for a predetermined time period of, preferably, thirty seconds or less.

Figure 5:
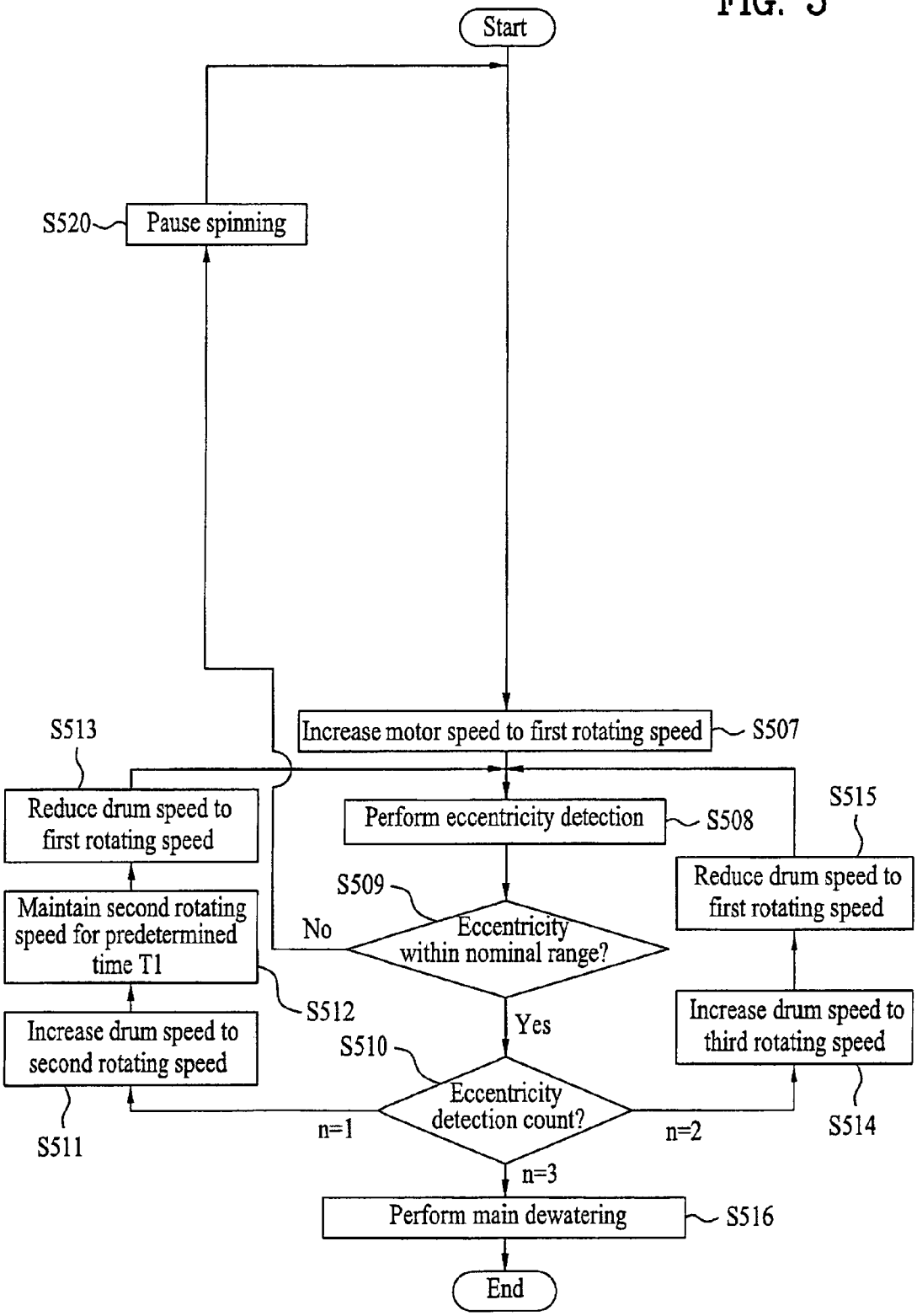
FIG. 5 is a flowchart showing steps of a method for controlling a drum-type washing machine in accordance with a first embodiment of the present invention.

FIG. 5 illustrates a method for controlling a drum-type washing machine in accordance with a first embodiment of the present invention. Here, dewatering is performed without a preliminary dewatering stage.

Referring to FIG. 5, the drum motor of a drum-type washing machine according to the present invention is accelerated (S507) to a first rotating speed (e.g., 100 rpm) for eccentricity detection (S508), which is a predetermined rotating speed causing the laundry to be held against the inner wall of the drum without falling from the lifts during rotation. This eccentricity detection speed is maintained for a predetermined time during which eccentricity is detected. Assuming that the detected eccentricity falls within a nominal range (S509), the drum motor is accelerated further to a second rotating speed (e.g., 250 rpm) for extracting water from the laundry, which is a predetermined rotating speed at which laundry would be forced outward and pressed tightly against an inner wall of the drum. The drum motor speed is accelerated based on a counter value (n) of, say, n=1, 2, or 3 (S510), updated for each instance of eccentricity detection. Otherwise, the drum rotation is paused (S520) so that the steps S507 and S508 can be repeated for a slightly reduced water load.

Upon reaching the second rotating speed (S511), the drum motor speed is maintained for a predetermined time T1 (S512) before being reduced to the first rotating speed (S513) for eccentricity detection to be again performed. Any sharp increase in eccentricity (unbalanced state of the drum), that is likely to occur as the rotating speed passes through the resonance range, in the step S513 is prevented since the extended period (T1) of drum rotation at the second rotating speed enables sufficient amounts of water to be extracted from the laundry before the resonance range is reached.

Thereafter, since a substantial amount of water has been extracted from the drum and the laundry, the next drum motor acceleration can be carried out at higher speeds, i.e., at rotating speeds surpassing the resonance speed. That is, assuming that the detected eccentricity is again within a nominal range, the drum motor speed is increased to a third rotating speed (e.g., 450 rpm), which is a predetermined speed at which laundry holds roughly the same amount of moisture irrespective of any specific water holding property of the material. Notably, the third rotating speed is beyond the resonance range (e.g., 300-400 rpm). Thus, the drum motor is accelerated through resonance (S514) and then may be again reduced to the first rotating speed (S515) for another eccentricity detection before entry to the main dewatering phase (S516), which is performed at the main dewatering speed or maximum rotating speed (e.g., 800-1600 rpm).

According to the present invention, the second rotating speed is determined based on system characteristics of the washing machine, including resonance characteristics of the motor and rotating drum. For example, the second rotating speed may be decreased for lower values of the detected amount of laundry, which is a rotating speed determined at the outset of a wash course according to laundry type and wash course selection. Thus, the second rotating speed is inversely proportional to the amount of laundry in the drum. Also, the slope of acceleration of the motor may be decreased for lower values of the detected amount of laundry, such that the slope is similarly in inverse proportion to the amount of laundry.

This determination of acceleration slope may be applied to an acceleration of the motor from a stopped state (at rest) as well as to motor acceleration from the eccentricity detection speed, e.g., from the first rotating speed to the second rotating speed. More gradual (less steep) slopes and slower rotating speeds are desirable for smaller amounts of laundry since a drum capacity that is less filled exhibits greater eccentricity levels when rotated; on the other hand, such eccentricity problems are usually absent when a drum that is more nearly filled to capacity is rotated at the same speed.

Meanwhile, the predetermined time T1 is proportional to the detected amount of laundry. Alternatively, however, the value of T1 may be set to a maximum value regardless of laundry amount, in which case a value of approximately thirty seconds is preferred.

Figure 1:
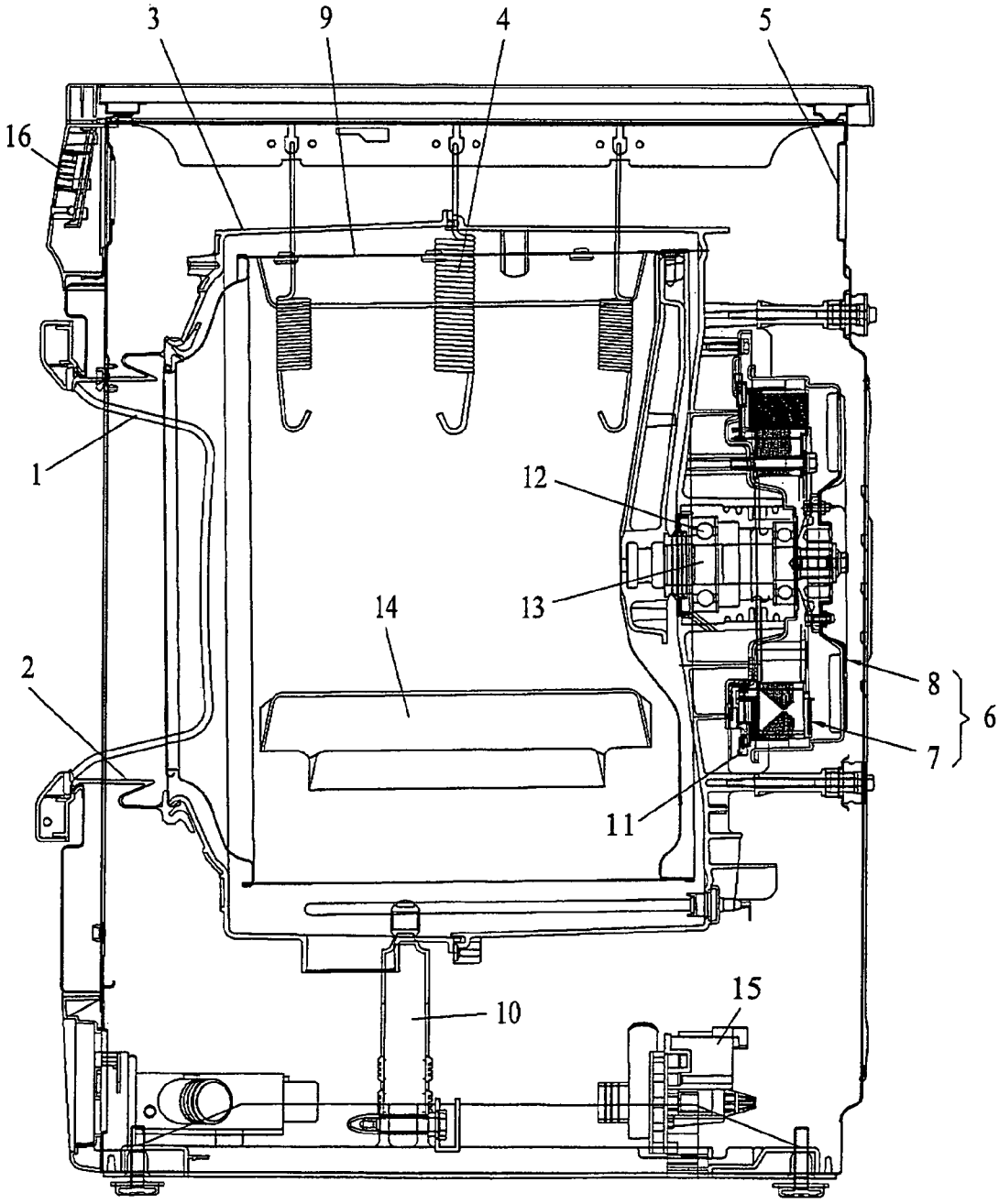
FIG. 1 Related Art
FIG. 1 is a cutaway, side view of a drum-type washing machine according to a related art.
Figure 2:
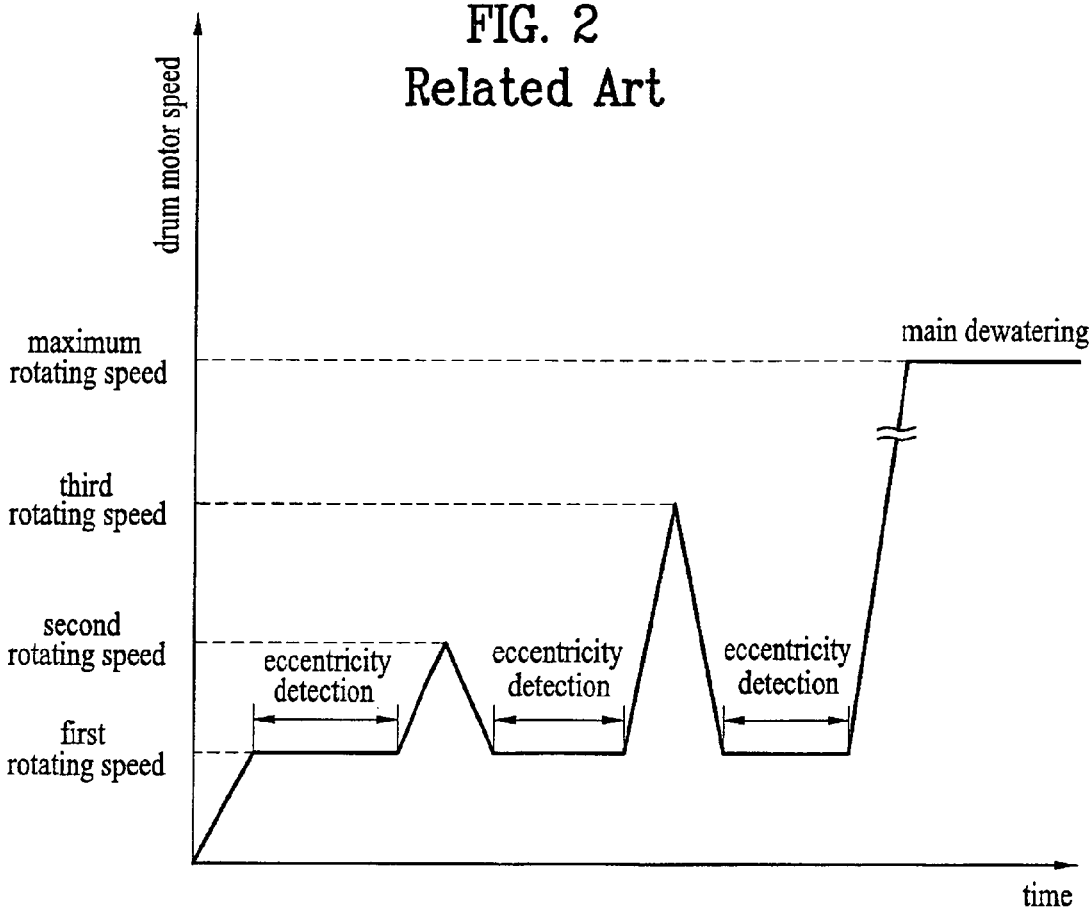
FIG. 2 Related Art
FIG. 2 is a graph for describing a contemporary dewatering process.
Figure 3:
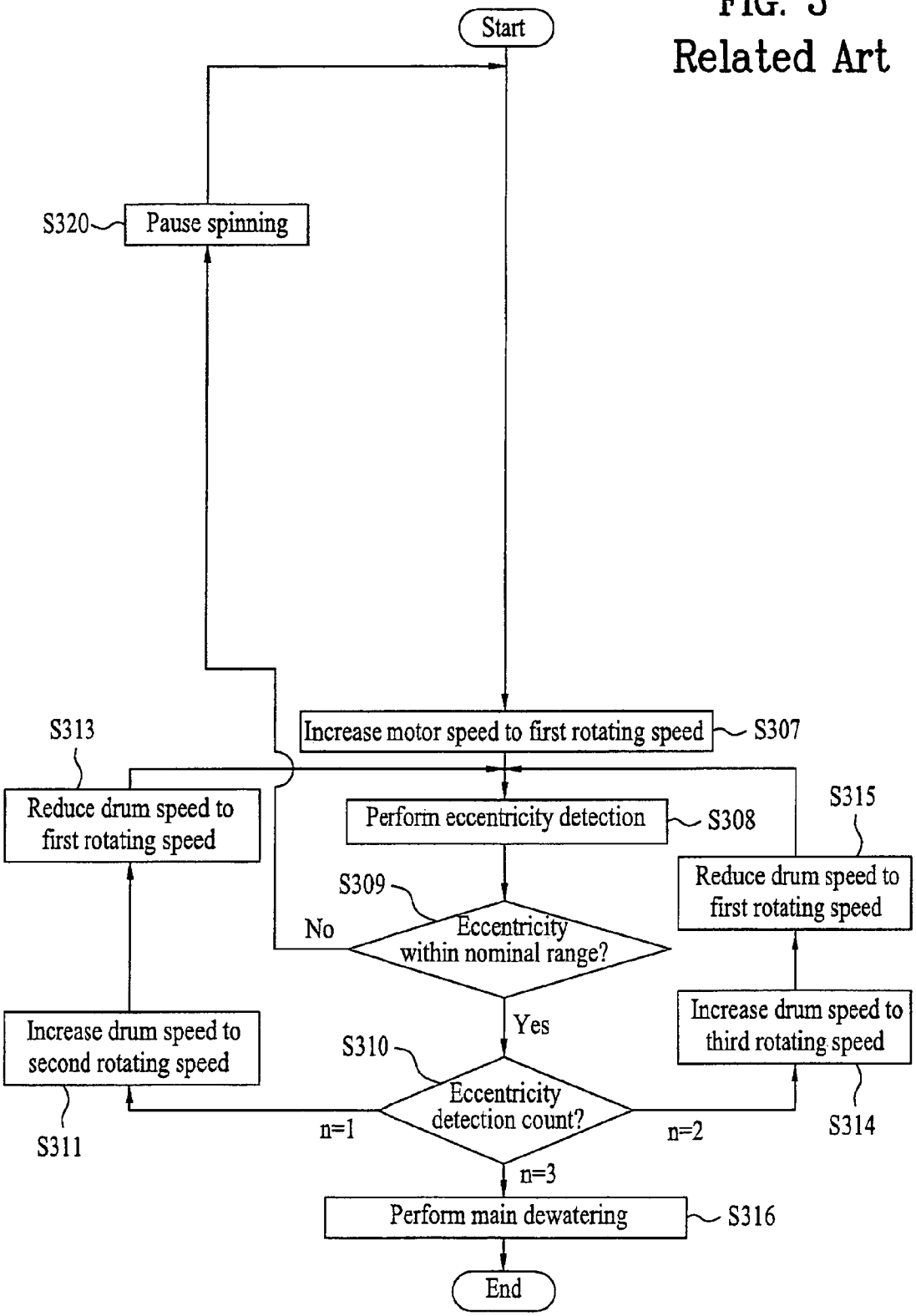
FIG. 3 Related Art
FIG. 3 is a flowchart showing steps of the dewatering process of FIG. 2.

The method of the present invention may be applied to an acceleration performed for the preliminary dewatering stage only. In other words, the main dewatering phase, which requires accelerating through the resonance range, can be entered after maintaining the preliminary dewatering speed for a predetermined time T2, as shown in FIG. 4, and thereafter performing a method similar to that of FIG. 3. As in the case of the first embodiment, the drum motor speed for the preliminary dewatering is greater than the eccentricity detection speed but still below resonance, depending on system characteristics, such that the preliminary dewatering speed may be different than the second rotating speed. Likewise, the eccentricity detection speed may be different than the first rotating speed.

Figure 6:
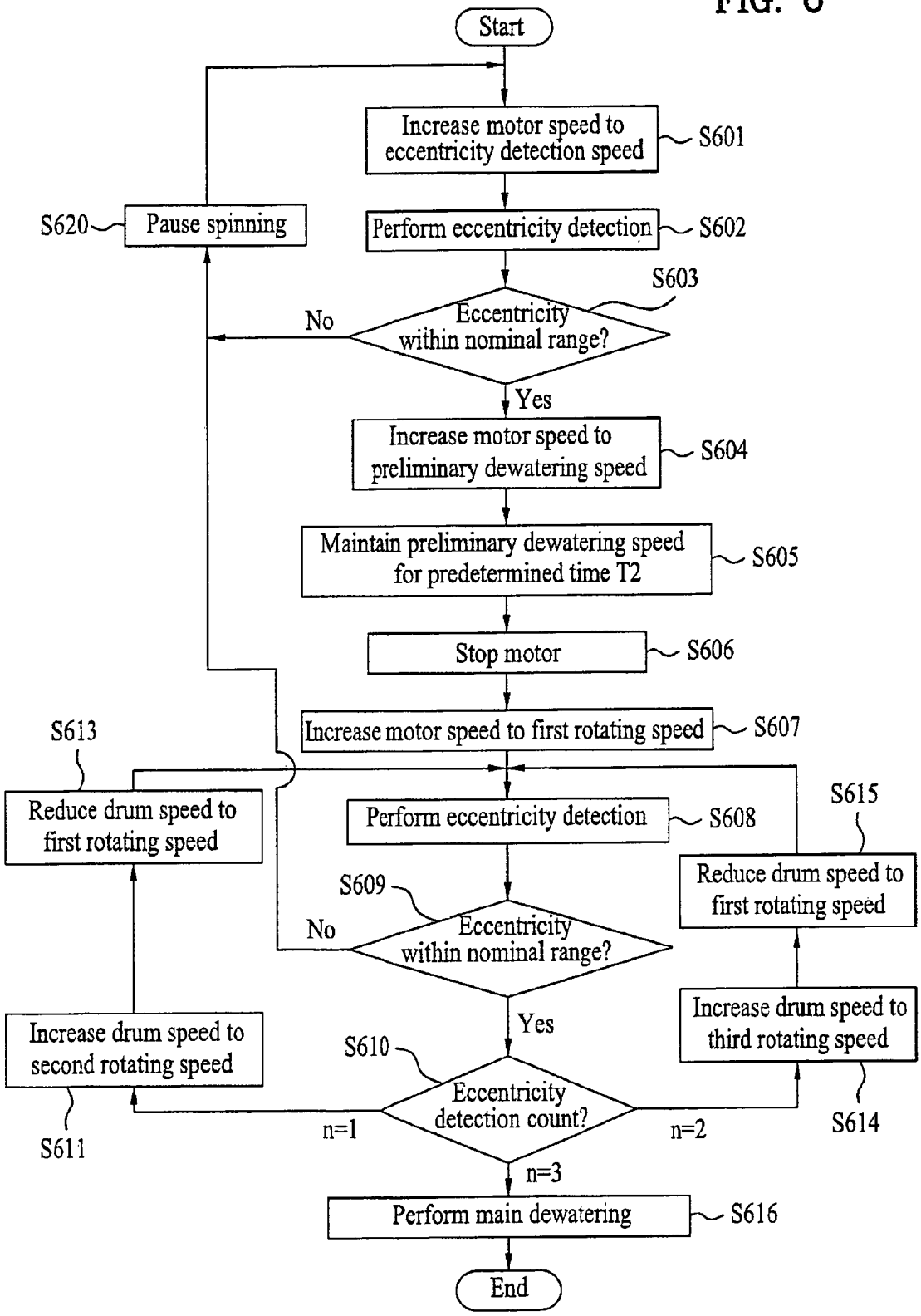
FIG. 6 is a flowchart showing steps of a method for controlling a drum-type washing machine in accordance with a second embodiment of the present invention.

FIG. 6 illustrates a method for controlling a drum-type washing machine in accordance with a second embodiment of the present invention. Here, dewatering is performed with a preliminary dewatering stage, and the method of the present invention may include more than one such stage. The preliminary dewatering stage is typically performed in conjunction with an initial eccentricity detection and includes an acceleration of the rotating speed of the drum motor, motor rotation at the preliminary dewatering speed, and a deceleration of the drum motor to a stopped state.

Referring to FIG. 6, drum motor speed is increased to an eccentricity detection speed (S601) or first rotating speed, whereupon eccentricity detection is performed (S602), and the detection results are processed (S603). Typically, eccentricity detection performed during a preliminary dewatering stage is applicable to large capacity washing machines, such that the main watering phase cannot be entered as a result of such detection, and the detection results are used merely to determine whether acceleration for higher rotating speeds is permissible or if spinning should be paused (S620).

Assuming that the detected eccentricity is within a nominal range, the motor speed is increased from the eccentricity detection speed to the preliminary dewatering speed (S604) or second rotating speed. The preliminary dewatering speed is maintained for a predetermined time T2 (S605), after which the motor is stopped (S606) before being increased to the first rotating speed (S607) to detect eccentricity. Contrary to the eccentricity detection stage of the step S602, this eccentricity detection stage may lead directly to an entry to the main dewatering phase. Steps S608-611 and steps S614-S616 are analogous to the corresponding steps of FIG. 5.

Though the predetermined time T2 may be equal to the predetermined time T1, the value of T2 is preferably set separately. For example, a maximum value of, say, thirty seconds, may be applied to the entire preliminary dewatering stage, i.e., including the acceleration period, the constant level period, and the deceleration period, rather to the constant level period only. The rotating speed and duration (T2) of the constant level period may also be based on the system characteristics of the washing machine.

Figure 7:
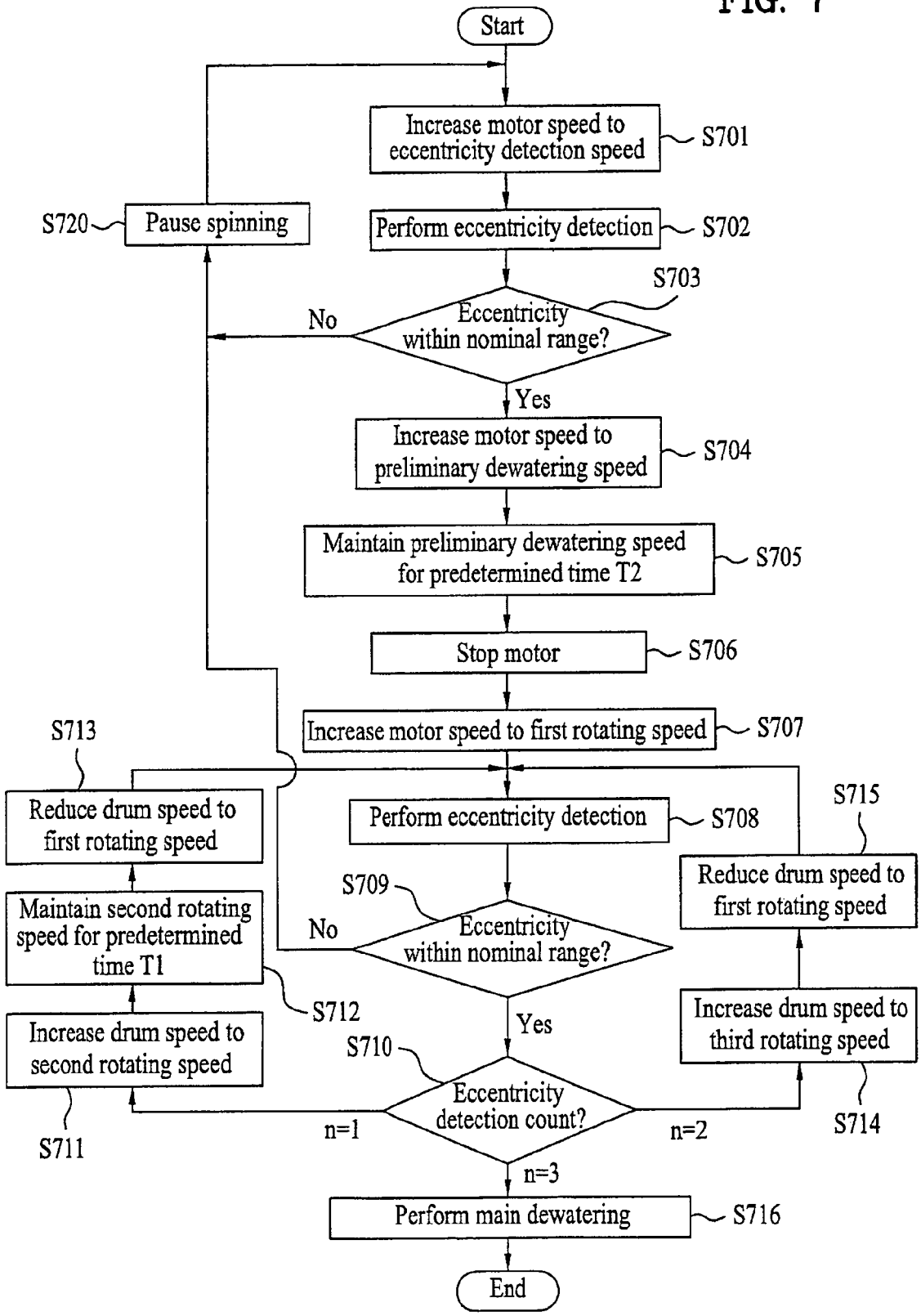
FIG. 7 is a flowchart showing steps of a method for controlling a drum-type washing machine in accordance with a third embodiment of the present invention.

Meanwhile, the method of the present invention may combine the features of the first and second embodiments to realize a method as shown in FIG. 7, illustrating a method in accordance with a third preferred embodiment of the present invention. Here, a preliminary dewatering stage as described in the second embodiment is applied to the method described in the first embodiment and is particularly applicable to very large capacity washing machines. In FIG. 7, steps S701-S707 are analogous to the steps S601-S607 of FIG. 6, and steps S708-S716 & S720 are analogous to the steps S508-S517 & S520 of FIG. 5.

Figure 8:
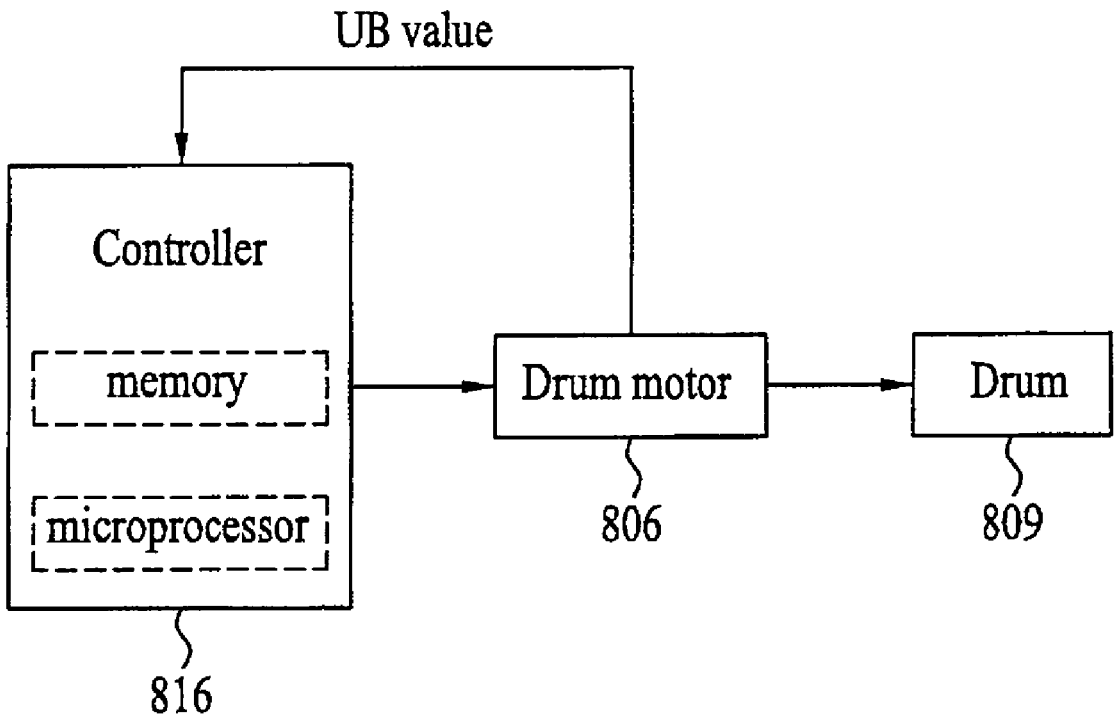
FIG. 8 is a block diagram of an apparatus for controlling a drum-type washing machine according to a preferred embodiment of the present invention.

Referring to FIG. 8, illustrating a drum-type washing machine according to the present invention, a controller 816 receives an eccentricity value, sometimes referred to as an unbalance or UB value, from a motor sensor (not shown) provided to a drum motor 806 for driving a drum 809 and controls the drive of the drum motor to spin the drum at a controlled rotating speed. The motor sensor detects and measures eccentricity exhibited in the drum 809 and experienced by the drum motor 806 and inputs the resulting eccentricity value to the controller 816, which processes the value according to a predetermined algorithm based on a wash course selected by the user via a control panel (not shown) and outputs to the drum motor 806 a control signal based on the input eccentricity value.

If the final UB value, i.e., the value obtained immediately preceding entry to the main dewatering phase, is within the nominal range, the current UB value is compared to the previous UB value, and the main dewatering speed is determined based on the comparison. In particular, if the current UB value is less than the previous UB value, the main dewatering speed is set according to the final UB value, but if the current UB value is greater than the previous UB value, the main dewatering speed is set according to the difference between the last two UB values. For example, if the difference value is less than a predetermined difference value, the main dewatering speed is set to a rotating speed corresponding to the lower UB value; and, if the difference value is greater than the predetermined difference value, the main dewatering speed is set to a rotating speed corresponding to the higher UB value. Accordingly, the load exerted on the system is reduced, and system stability is enhanced (i.e., "walking" is prevented).

As described above, the method for controlling a drum-type washing machine according to the present invention reduces the time required to perform dewatering while maximizing system stability by considering sharp rises in eccentricity levels upon advancing to a next drum motor acceleration stage. Accordingly, the eccentricity levels experienced at the onset of the next drum motor acceleration stage can be reduced, so that the dewatering process advances to the next drum motor acceleration stage with a reduced eccentricity level, which in turn prevents the occurrence of a "walking" phenomenon and reduces noise levels generated by an excessive twisting of a gasket or by the tub striking the cabinet, while facilitating an early entry to a main dewatering phase.

It will be apparent to those skilled in the art that various modifications and variations can be made in the present invention without departing from the spirit or scope of the inventions. Thus, it is intended that the present invention covers the modifications and variations provided they come within the scope of the appended claims and their equivalents.

What is claimed is:

1. A method for controlling a drum-type washing machine during a dewatering process in which a motor, coupled to a drum, rotates the drum to extract water from laundry contained in the drum, the method comprising:

detecting, before the dewatering process, an amount of laundry in the drum;

rotating the motor at a first rotating speed;

performing at least one eccentricity detection at the first rotating speed being proportional to the detected amount of laundry, to obtain an eccentricity value;

accelerating, if the obtained eccentricity value is within a nominal range, the motor from the first rotating speed to a second rotating speed, the second rotating speed being lower than a resonance range of the motor and rotated drum; and entering a main dewatering phase based on said at least one eccentricity detection and wherein the main dewatering phase of the dewatering process is performed at a main dewatering speed determined based on the detected amount of laundry, and wherein the main dewatering speed is set according to a comparison of two successive eccentricity values obtained by said at least one eccentricity detection, and wherein the main dewatering phase is entered after obtaining a final eccentricity value by said at least one eccentricity detection;

wherein the second rotating speed of the motor is maintained at a constant level for a first predetermined time before the main dewatering phase is entered;

wherein the two successive eccentricity values consist of a current unbalance (UB) value and a previous UB value; and wherein, if the final eccentricity value permits entry to the main dewatering phase, the main dewater speed is set according to the final UB value obtained immediately preceding entry to the main dewatering phase when the current UB value is less than the previous UB value and is set according to the difference between the last two UB values when the current UB value is greater than the previous UB value.

2. The method as claimed in claim 1, wherein the second rotating speed of the motor is less than a main dewatering speed for carrying out the main dewatering phase of the dewatering process.

3. The method as claimed in claim 1, further comprising:

performing, after said second rotating speed acceleration, a successive eccentricity detection at the first rotating speed, to obtain a successive eccentricity value; and accelerating, if the obtained successive eccentricity value is within a corresponding nominal range, the motor from the first rotating speed to a third rotating speed, to thereby accelerate the motor through the resonance range.

4. The method as claimed in claim 3, wherein the third rotating speed of the motor is less than a main dewatering speed for carrying out the main dewatering phase of the dewatering process.

5. The method as claimed in claim 3, further comprising:

decelerating the motor from the second rotating speed to the first rotating speed after said second rotating speed acceleration.

6. The method as claimed in claim 3, further comprising:

decelerating the motor from the third rotating speed to the first rotating speed after accelerating the motor through the resonance range.

7. The method as claimed in claim 1, further comprising:

comparing two successive eccentricity values obtained by said at least one eccentricity detection to determine an entry to the main dewatering phase.

8. The method as claimed in claim 1, wherein the second rotating speed is determined based on system characteristics of the washing machine.

9. The method as claimed in claim 1, wherein the first predetermined time is proportional to the detected amount of laundry.

10. The method as claimed in claim 1, wherein the second rotating speed is inversely proportional to the detected amount of laundry.

11. The method as claimed in claim 1, wherein the acceleration of the motor to the second rotating speed exhibits a slope that is inversely proportional to the detected amount of laundry.

12. The method as claimed in claim 1, wherein, if the difference value is less than a predetermined difference value, the main dewatering speed is set to a rotating speed corresponding to the lower of the two successive eccentricity values; and, if the difference value is greater than the predetermined difference value, the main dewatering speed is set to a rotating speed corresponding to the higher of the two successive eccentricity values.

13. The method as claimed in claim 1, wherein the first predetermined time is set to a maximum value.

14. The method as claimed in claim 13, wherein the maximum value is thirty seconds.

15. The method as claimed in claim 1, further comprising:

at least one preliminary dewatering stage performed prior to said first rotating speed acceleration.

16. The method as claimed in claim 15, further comprising:

accelerating the motor to an eccentricity detection speed to determine eccentricity of the rotated drum.

17. The method as claimed in claim 16, wherein said at least one preliminary dewatering stage comprises:

accelerating a motor from the eccentricity detection speed to a preliminary dewatering speed;

maintaining the preliminary dewatering speed at a constant level for a second predetermined time; and decelerating the motor.

18. The method as claimed in claim 17, wherein said decelerating brings the motor to a stopped state.

19. The method as claimed in claim 17, wherein the first and second predetermined times are set differently.

20. The method as claimed in claim 17, wherein the first and second predetermined times are equal.

21. The method as claimed in claim 17, wherein the first rotating speed and the preliminary dewatering speed are set differently.

22. The method as claimed in claim 17, wherein said accelerating the motor to the preliminary dewatering speed, said maintaining the preliminary dewatering speed at the constant level, and said decelerating the motor is completed in less than thirty seconds.

23. The method as claimed in claim 17, wherein the second predetermined time is set to a maximum value.

24. The method as claimed in claim 23, wherein the maximum value is thirty seconds.

25. The method as claimed in claim 1, further comprising:

rotating the motor at a preliminary dewatering speed and then decelerating the motor to a stopped state;

accelerating the motor from the stopped state to a first rotating speed;

performing at least one eccentricity detection at the first rotating speed, to obtain an eccentricity value;

accelerating, if the obtained eccentricity value is within a nominal range, the motor from the first rotating speed to a second rotating speed, the second rotating speed being lower than a resonance range of the motor and rotated drum; and entering a main dewatering phase based on said at least one eccentricity detection, wherein the preliminary dewatering speed of the motor is maintained at a constant level for a predetermined time before the main dewatering phase is entered.

* * * * *